US005687491A

United States Patent [19]

Klebahn

[11] Patent Number: 5,687,491

[45] Date of Patent: Nov. 18, 1997

[54] SNOWSHOE WITH CONTOURED FOOTBED

[75] Inventor: Perry A. Klebahn, San Francisco, Calif.

[73] Assignee: Atlas Snow-Shoe Company, San Francisco, Calif.

[21] Appl. No.: 592,125

[22] Filed: Jan. 26, 1996

[51] Int. Cl.[6] ..... A43B 5/04

[52] U.S. Cl. ..... 36/124; 36/122; 36/125

[58] Field of Search ..... 36/122, 123, 124, 36/125

[56] References Cited

U.S. PATENT DOCUMENTS

| | | | |
|---|---|---|---|
| 2,738,596 | 3/1956 | Walsh | 36/124 |
| 3,555,707 | 1/1971 | Sharratt et al. | 36/123 |
| 3,596,374 | 8/1971 | Covington | 36/125 |
| 3,600,829 | 8/1971 | La Violette . | |
| 3,755,926 | 9/1973 | Schonbrun . | |
| 3,802,100 | 4/1974 | Prater | 36/124 |
| 3,885,327 | 5/1975 | Maki | 36/125 |
| 4,085,529 | 4/1978 | Merrifield | 36/125 |
| 4,271,609 | 6/1981 | Merrifield | 36/125 |
| 4,620,375 | 11/1986 | Wallace | 36/125 |
| 4,720,928 | 1/1988 | Faber et al. | 36/122 |
| 5,253,437 | 10/1993 | Klebahn et al. | 36/125 |
| 5,440,827 | 8/1995 | Klebahn et al. | 36/122 |
| 5,493,794 | 2/1996 | McKenzie et al. | 36/124 |

FOREIGN PATENT DOCUMENTS

| | | | |
|---|---|---|---|
| 1080760 | 7/1980 | Canada | 36/122 |

*Primary Examiner*—M. D. Patterson
*Attorney, Agent, or Firm*—Thomas M. Freiburger

[57] ABSTRACT

A snowshoe has a front claw and shoe harness assembly including a molded, conclave footpad. The footpad has front-to-back concavity so as to cradle the ball of the user's foot, helping the user locate the foot properly and preventing slippage fore-and-aft and rotationally relative to the snowshoe. In preferred embodiments, the contoured footpad is of a rubbery, somewhat compliant material to further promote friction and cradling of the ball of the shoe.

8 Claims, 3 Drawing Sheets

SNOWSHOE WITH CONTOURED FOOTBED

BACKGROUND OF THE INVENTION

The invention relates to snowshoes, and more specifically the invention is concerned with the binding on the snowshoe for retaining a shoe or boot in position. The invention is directed to avoidance of foot slippage in the binding harness system of the snowshoe and to generally increasing comfort and stability of the user in use of the snowshoes.

Snowshoe harnesses are known, in several different styles and configurations. As examples, see U.S. Pat. Nos. 5,253,437 and 5,440,827. Types of bindings are also shown in U.S. Pat. Nos. 4,720,928, 4,620,375, 4,271,609, 3,755,926 and 3,600,829. A problem with conventional snowshoe bindings has been that the user's shoe often tends to slip in the binding either forward or backward or in rotation (or pronation) relative to the snowshoe. Nearly all conventional snowshoes have experienced some degree of problem with pronation or foot slippage. As a result, the snowshoes feel clumsy and are not used properly because of lack of proper orientation on the shoes.

Typical snowshoes prior to this invention have had a flat area over a pivoting front cleat, where the foot is held down by some form of strap system. Tightening of the straps applies downward pressure to hold the shoe downward against this flat area. This has not been sufficient to avoid foot slippage and pronation. As a result, conventional snowshoes have allowed the foot to slip fore and aft and to twist off the centerline of the snowshoe, making walking awkward.

SUMMARY OF THE INVENTION

In accordance with the invention described herein, a molded, contoured footbed is provided on the shoe binding of a snowshoe, preferably in combination with a pivoting front cleat. This contour below the foot tends to promote consistent placement of the user's foot on the shoe harness, while also providing some mechanical advantage for holding the user's shoe in a stable position relative to the snowshoe during use, preventing the shoe from sliding forward or backward or twisting.

In typical shoes and boots, there is included a degree of "toe spring", a slight upward curve including the ball of the shoe sole and extending generally up to the front tip of the sole, such that when one stands in a pair of shoes, a finger can usually be placed between the sole's tip and the floor. Some shoes, such as hiking boots, have included a considerable degree of toe spring, and in fact most boots or shoes which would be used with snowshoes have a fairly pronounced toe spring. Toe spring establishes a contoured fore-and-aft curve at the bottom of the sole, and the present invention takes advantage of this existing shoe or boot shape in the provision of a contoured footbed or footpad in the harness assembly of the snowshoe. Preferably, this molded footbed is of a synthetic rubber material, an example being a product sold as Goodyear 500, Hardness can be about 30 to 120 shore, more preferably about 30 to 80. The material of the molded footpad is important, to avoid significant abrasion and to provide adequate compliance as well as shape retention, and to allow purchase in a wet environment. The molded, contoured footpad can be secured down to a concavely curving rigid portion of the front cleat of the snowshoe, or the pad can itself include the desired contour so that it can lie on a planar surface of the cleat.

The footbed or footpad of the invention is preferably a molded or diecut part which is attached to the rigid surface beneath by rivets or bolting, gluing or both. In preferred embodiments, the rigid surface comprises the upward facing surface of the pivoting front cleat of the snowshoe. With the contoured footbed of the invention, the harness system of the snowshoe holds a user's foot firmly to the pivoting cleat or claw at the front of the snowshoe.

It is therefore among the objects of the invention to improve the comfort and stability of snowshoeing by providing a contoured footbed or footpad for cradling the sole of the user's foot, at the ball of the foot. In preferred embodiments the ball of the foot is cradled directly over the axis of rotation of the snowshoe toe cleat. The footpad is formed of material which is compliant as well as providing a high degree of friction between the footbed and the sole of the shoe or boot, in order to reduce to a minimum any relative movement between the footbed and harness system and the user's shoe. These and other objects, advantages and features of the invention will be apparent from the following description of a preferred embodiment, considered along with the accompanying drawings.

DESCRIPTION OF PREFERRED EMBODIMENTS

Figure 1:
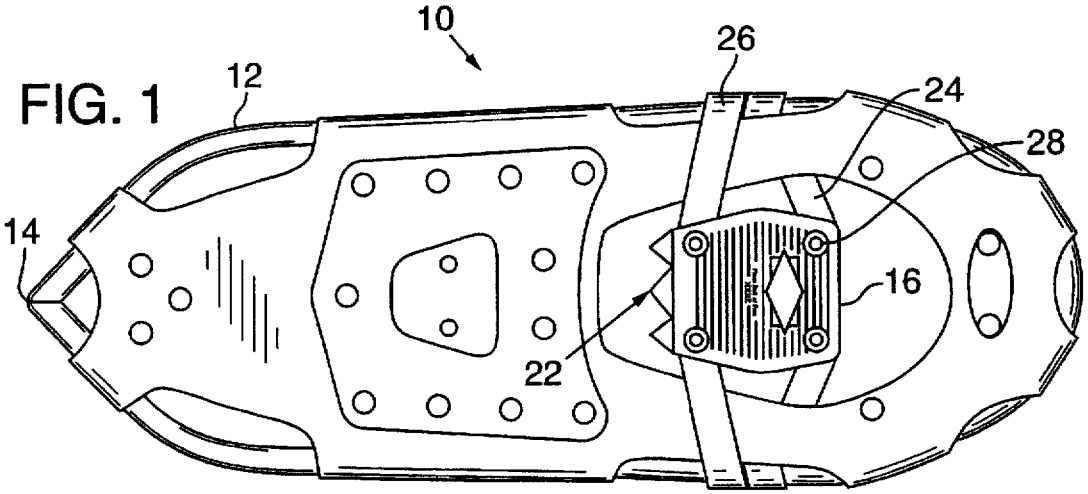
FIG. 1 is a somewhat schematic plan view of a snowshoe which includes the contoured footbed of the invention.

FIG. 1 shows a snowshoe 10 of the type with which this invention is concerned. The snowshoe 10 has an outer frame 12, preferably tubular in construction, welded at a tail joint 14. A harness assembly of the snowshoe includes a footbed 16 which, in accordance with the invention, is contoured as described further below. Portions of the harness assembly, including straps which engage around the user's shoe or boot, are not shown in FIG. 1. A pair of straps 18 are shown in FIG. 2, engaged around the user's boot 20.

Figure 2:
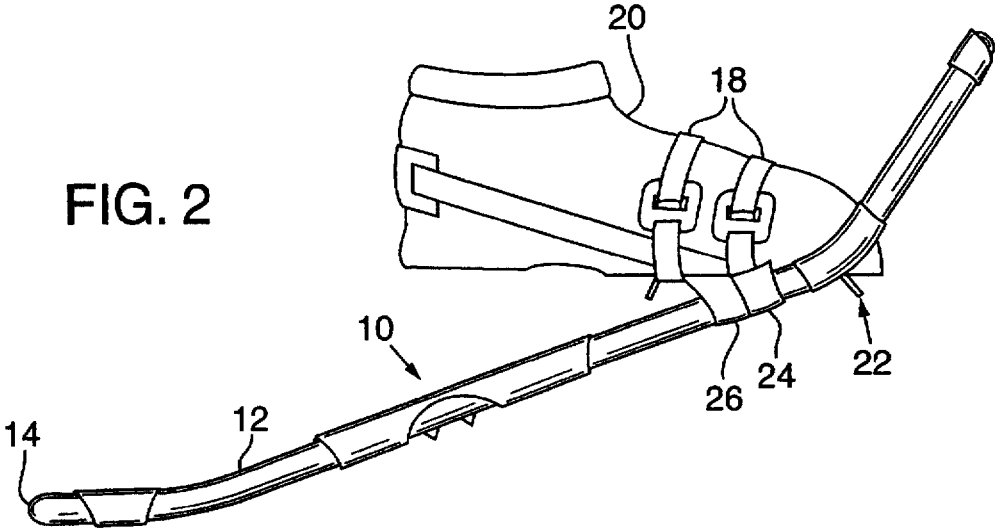
FIG. 2 is a schematic side elevation view showing a snowshoe such as shown in FIG. 1, with a user's boot secured in a binding or harness of the snowshoe, in a position of use with the foot lifted.

As shown in FIGS. 1, 2, 5 and 6, the molded, contoured footbed 16 is secured to a rigid front cleat or claw 22, being engaged against the top surface of the rigid claw, which preferably is of metal. FIGS. 1 and 2 show that the rigid cleat 22 and footbed 16 are secured to the frame 12 in a manner to permit pivoting of the toe assembly, preferably with a bias toward the position shown in FIG. 2. FIG. 2 shows that the snowshoe frame tips downwardly at its rearward end when the user lifts his foot. In the preferred embodiment illustrated, the pivoting and biasing of the front claw assembly are achieved via a pair of straps 24 and 26 which span across the frame, below and above the frame as illustrated, under tension. The footbed 16 and rigid claw 16 are secured to these straps by rivets or other fasteners 28 as illustrated.

Figure 4:
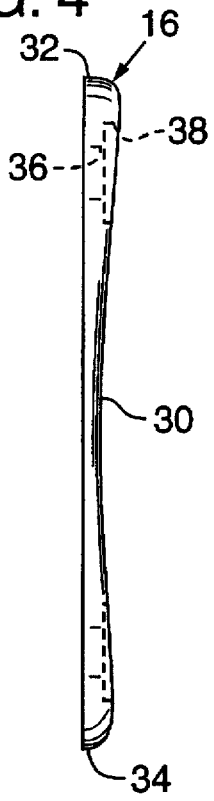
FIG. 4 is a sectional or elevation view showing the contour of the footbed shown in FIG. 3, with front-to-rear concavity.
Figure 3:
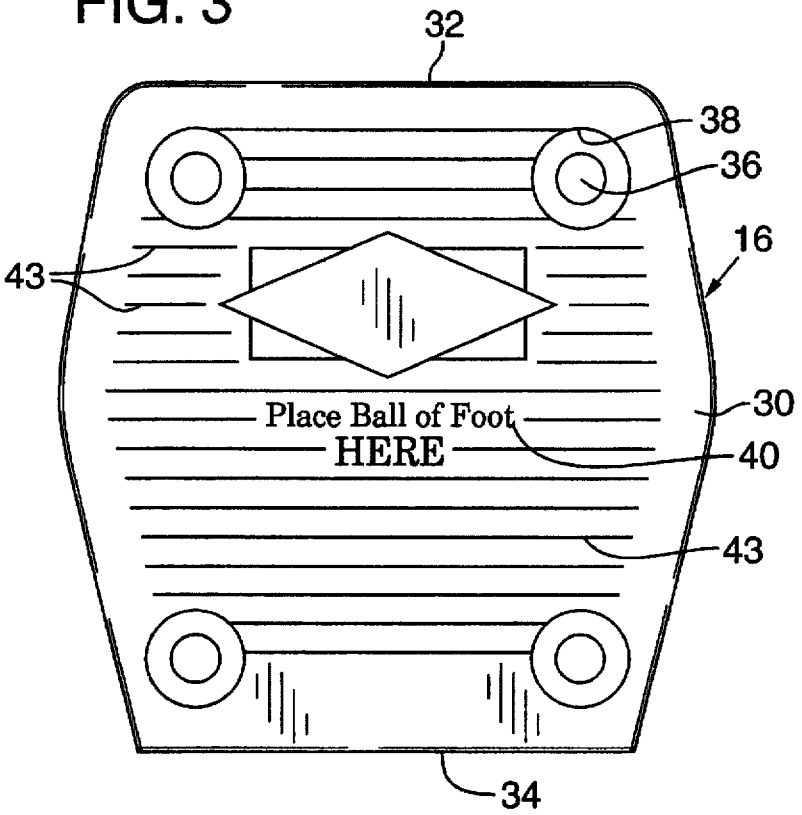
FIG. 3 is a plan view showing a contoured footbed component of the invention, which is incorporated in the snowshoe of FIG. 1.

FIGS. 3 and 4 show the contoured footbed or footpad 16 in greater detail, in plan and profile views. In the plan view of FIG. 3 it is seen that the footbed 16 can have a wide center 30, tapering to narrower dimensions at a front edge 32 and a rear or trailing edge 34. Holes 36 with counterbores 38 are provided, to accommodate the heads of rivets or other fasteners, as also shown in FIG. 4.

Figure 6:
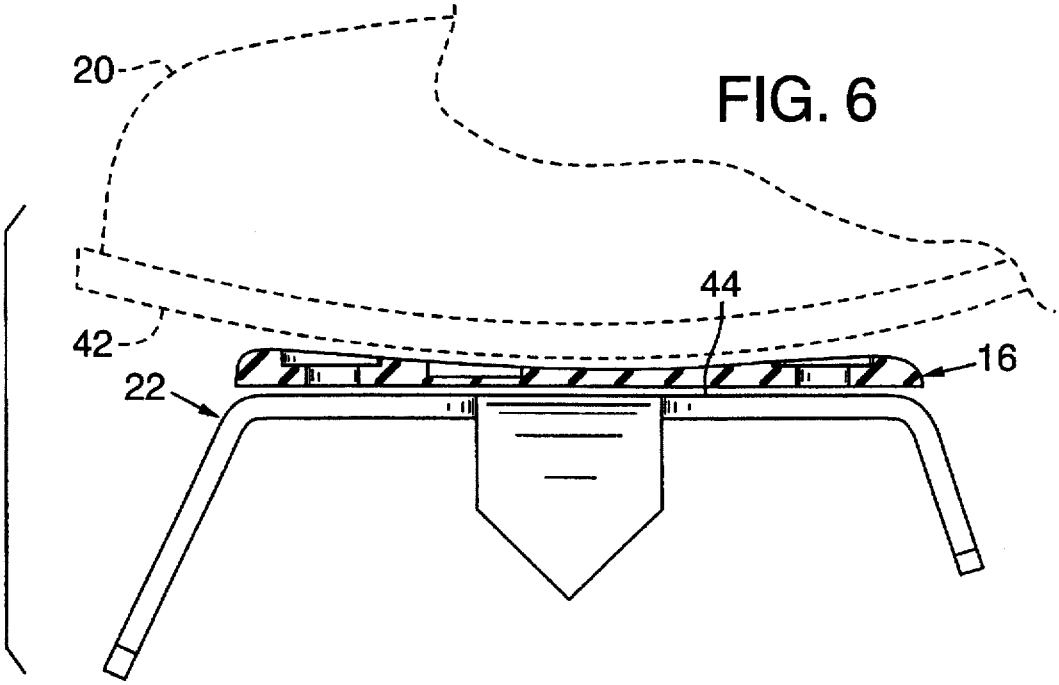
FIG. 6 is a side elevation view, partly in section, showing the contoured footpad and toe cleat and indicating in dashed lines a user's shoe or boot above the footpad.

The dimensions of the molded footbed 16 are such as adequate to cradle the ball of the foot, and to tend to locate the shoe in a secure and stable position on the snowshoe. In one preferred embodiment, the footpad is about 3½ inches long, from front edge 32 to back edge 34, and about 3½ inches wide at its center 30. A shoe or boot 20 is indicated in dashed lines in FIG. 6, illustrating that the footpad 16 follows the contour of the bottom of the shoe sole 42, particularly when the user's weight is placed against the snowshoe. An instruction 40 can be included, indicating that the user should put the ball of the foot at the center of the footpad.

Figure 5:
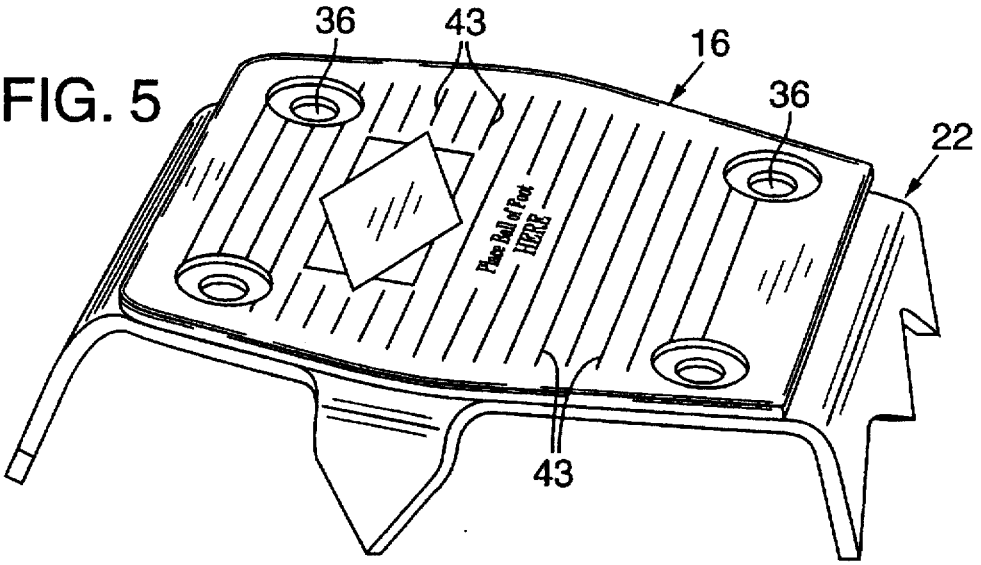
FIG. 5 is a perspective view showing the contoured footpad as secured on a toe cleat which forms a part of a harness assembly in a snowshoe.

As seen particularly in FIGS. 3 and 5, the top surface of the footpad 16 preferably includes a series of grooves 43. These may be at approximately 4 mm spacing and with a depth of about 1 mm and a width of about 1 mm. The grooves, in cooperation with the compliance material and the contour, help hold the boot sole in position.

FIG. 5 shows the molded footpad 16 against the upper surface of the rigid front claw 22, which may be of aluminum. The front claw 22 is generally as shown in U.S. Pat. Nos. 5,440,827 and 5,253,437. In addition to securing of the footpad to the claw 22 via the fastener holes 36, the bottom of the footpad preferably is also adhered to the top surface of the claw 22 by gluing.

FIG. 6 shows that the top surface 44 of the front claw 22 preferably is flat and planar, matching the bottom side of the footpad 16, with all footpad contour arising from the molded shape of the footpad itself. However, if desired the rigid claw 22 can have a dished or concave shape, forming part or all of the contour required, so that the footpad follows such contour when adhered to the claw.

FIGS. 4 and 6 show the general contour of the upper surface of the molded footbed or footpad, which is generally front-to-back concave. The curvature can be arcuate, elliptical, hyperbolic or other desired shapes, the precise shape of the curve not being critical because of the large radius, the compliant material from which the footpad preferably is made, and the ability of the user's shoe sole to conform to some degree when weight is place on the footpad. If the curvature is circular, or approximates an arc, one preferred radius is about 13 inches. More broadly, a preferred range of radius is one which will produce a "dip" in the range of about 1/32 to ½ inch over the contour area of the footbed (which may extend from about the front of the leading rivet hole counterbores 38 to about the middle of the trailing counterbores 38, which may be a distance of about 2¾ inches)

As noted above, the material from which the molded footpad 16 is made preferably is somewhat compliant, with a high coefficient of friction against a typical boot sole, even with moisture present. The material, which may be an artificial rubber, preferably has a hardness in the range of about 30 to 80 shore. The selection of a material that is softer than the sole of a user's shoe tends to provide maximum friction and help prevent the shoe sole from sliding forward or aft, as well as helping to prevent rotation relative to the center line of the snowshoe. This, in combination with the cupping against the user's footwear due to the contoured shape of the footpad, tends to stably locate the user's foot on the snowshoe and to prevent slipping and pronation. In addition, as explained above, the contoured shape of the molded footbed helps the user to initially find the proper location of the ball of the foot on the shoe harness assembly of the snowshoe, further assuring stability.

The above described preferred embodiments are intended to illustrate the principles of the invention, but not to limit its scope. Other embodiments and variations to this preferred embodiment will be apparent to those skilled in the art and may be made without departing from the spirit and scope of the invention as defined in the following claims.

I claim:

1. In a snowshoe having a frame, a deck supported by the frame, a front claw and a footwear harness assembly connected to the front claw for securing a ball portion of a user's shoe or boot to the snowshoe, the improvement comprising:

the front claw being rigid and having an upper surface and having means for pivotally attaching said claw to said frame with a generally horizontal axis of rotation, and a footbed fixedly secured to the upper surface of the front claw, so that the footbed moves in unison with the front claw, the footbed having a contoured upper surface such that the footbed is concave in that a front end and a rear end of the footbed are higher than a central area of the footbed, so as to cradle the bottom of the user's shoe or boot at the ball of the foot, directly over the generally horizontal axis of rotation of the front claw, whereby the contoured upper surface of the footbed helps the user properly locate the ball of the foot on the footbed and on the front claw of the snowshoe, and whereby the contour of the footbed helps prevent slipping of the user's shoe fore and aft and in rotation relative to the snowshoe.

2. A snowshoe as in claim 1, wherein the footbed is of rubbery, compliant material, whereby the softness of the footbed helps prevent slipping of the shoe or boot relative to the snowshoe.

3. A snowshoe as in claim 1, wherein the upper surface of the contoured footbed has a contoured area with a radius of curvature which establishes a height difference in the footbed surface of about 1/32 to about ½ inch.

4. A snowshoe as in claim 3, wherein the upper surface of the contoured footbed has an approximate radius of curvature of about 13 inches.

5. A snowshoe as in claim 1, wherein the upper surface of the footbed includes a series of lateral grooves for improving friction with the sole of the user's shoe or boot.

6. A snowshoe as in claim 2, wherein the footbed has a hardness in the range of about 30 to 120 shore.

7. A snowshoe as in claim 1, wherein the snowshoe includes a pair of tensioned straps extending laterally across the snowshoe frame, and wherein the contoured footbed is secured to the front claw and to the tensioned straps.

8. A snowshoe as in claim 1, wherein the contoured footbed is adhered to the upper surface of the front claw by glue.

* * * * *